United States Patent [19]

Beauplat

[11] 3,938,416

[45] Feb. 17, 1976

[54] PUNCHING OR NIBBLING PRESSES HAVING A TURRET

[76] Inventor: Philippe L. Beauplat, 44 rue de Montmorency, 95230 Soisy-sous-Montmorency, France

[22] Filed: Sept. 5, 1974

[21] Appl. No.: 503,264

[30] Foreign Application Priority Data

Sept. 12, 1973 France ..... 73.32803

[52] U.S. Cl. ..... 83/552; 29/36; 72/442

[51] Int. Cl.[2] ..... B26D 5/08

[58] Field of Search ..... 72/442, 421, 417, 419; 83/552, 550, 916, 411; 29/36, 40, 26 A, 568

[56] References Cited

UNITED STATES PATENTS

| | | | |
|---|---|---|---|
| 3,449,991 | 6/1969 | Daniels | 83/552 |
| 3,745,646 | 7/1973 | Kristiansson | 83/552 |
| 3,816,904 | 6/1974 | Herb | 29/568 |

*Primary Examiner*—C. W. Lanham
*Assistant Examiner*—Robert M. Rogers
*Attorney, Agent, or Firm*—Bucknam and Archer

[57] ABSTRACT

A puching press with a very strong main swanneck frame having an upper arm carrying a punching head equipped with an actuating slide, and a lower arm provided with an anvil. A rotary turret is provided with a plurality of punches engageable selectively with the actuating slide by rotation of the turret, and the turret is also provided with a plurality of punching dies each corresponding to a punch and locatable over the anvil by synchronous rotation with the punches. The turret is mounted on a second swanneck frame disposed outside of the slot of the first swanneck frame.

5 Claims, 4 Drawing Figures

Figure 1:
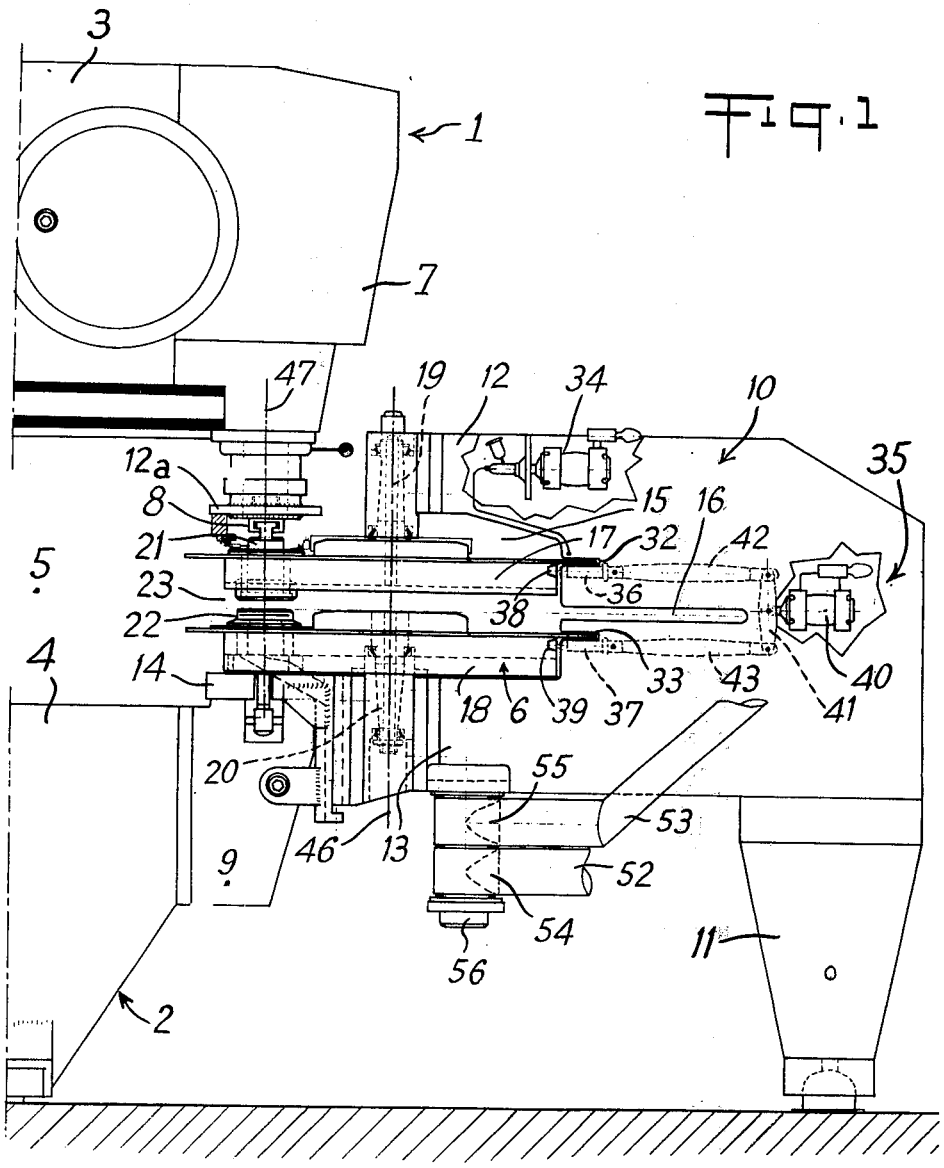

1
2
6
7
10
11
19
24
25
26
27
28
29
30
31
44
45
48
49
50
51
58
59
60
61
62

PUNCHING OR NIBBLING PRESSES HAVING A TURRET

The present invention relates to punching or nibbling presses having a turret.

These presses comprise a swanneck frame defining, for the passage and movement of the metal sheet to be machined, a slot separating a lower arm from an upper arm. They also comprise a turret having two plates separated from each other and supporting, in facing relationship, movable punches and the corresponding dies, these plates being mounted to rotate about a common geometric axis on the frame, inside the slot and being able to be rotated selectively and in synchronism by a driving device. The lower arm of the frame constitutes an anvil for the selected die of the turret, brought into a facing relationship by the drive device. The upper arm of the frame guides a striker slide moved in vertical alternating translation by an appropriate device in order to actuate the punch of the turret associated with the selected die.

It is clear that owing to the bulk of the turret, its location inside the slot of the frame and the necessary presence of mechanisms controlling this turret, the swanneck is weakened.

Under these conditions, for a given depth of the slot, one is forced either to accept that the punching power of the punching press having a turret is reduced with respect to that of a simple punching press (i.e. without a turret) of the same dimensions, or to considerably reinforce the frame in order that it does not deform in the case of equal power.

Generally, in order to remain within acceptable limits of power, strength and cost price, designers manufacture punching presses having a turret, whereof the slot is less deep than that of simple punching presses. This does not prevent these presses having a turret from being relatively expensive.

It is the object of the present invention to remedy these drawbacks. Indeed, according to this invention, the press comprises, in combination:

firstly, a first swanneck frame which, since it is provided solely with the striker slide and anvil, has a slot of slight height adapted to the passage of the thickest sheets and is thus very compact and strong in order to resist the cutting forces, secondly, a second swanneck frame located outside the first and whereof the arms support the two plates of the turret which are disposed in a relatively high slot of this second swanneck, which may be of slight strength since it is sufficiently rigid to ensure precise positioning of the turret relative to the striker slide.

Under these circumstances, owing to the face that it is absolutely identical to a simple punching press, the punching press limited to the first swanneck frame has qualities at least as good as the latter: its strength, high punching power, considerable capacity (the width of the metal sheets depending on the depth of the slot) etc...

Therefore, either the performances of the press of the invention are improved in comparison with those of a conventional punching press having a turret of similar construction, or the construction of this press of the invention may be simplified and made more economical than that of a conventional punching press having a turret, which would aim for the same performances as a simple punching press of the same capacity.

In addition, the improvement, which is the object of the invention, makes it possible to transform any existing simple punching press into an automatic punching press having a turret, by simply mounting the second swanneck having a turret relative to the swanneck of the existing machine.

Furthermore, owing to the presence of a second swanneck, the table supporting the metal sheet to be machined during its movement, may be improved and its floor supports eliminated. This results in an improvement of the performances within the framework of automation and a decrease in the magnitude and cost of installation work.

In fact, according to the invention, a fixed member of the table is supported by the second swanneck frame and has a circular shape partially surrounding the turret and eccentric with respect to the latter opposite the first frame, whereas two movable lateral members of this table have a curved inner edge adjacent the outer edge of the fixed member and are integral with descending arms which are pivotally mounted on the second swanneck frame about a geometric axis parallel to that of the turret and centered on this fixed member, these arms being connected to a mechanism for symmetrical synchronous drive bearing against this second frame through the intermediary of a device for regulating the plane of symmetry of said moving members with respect to the plane defined by the axis of the turret and the pivot axis of said arms.

Various other features and advantages of the invention will become apparent from the following detailed description.

One embodiment of the object of the invention is illustrated as a non-limiting example in the accompanying drawings.

Figure 2:
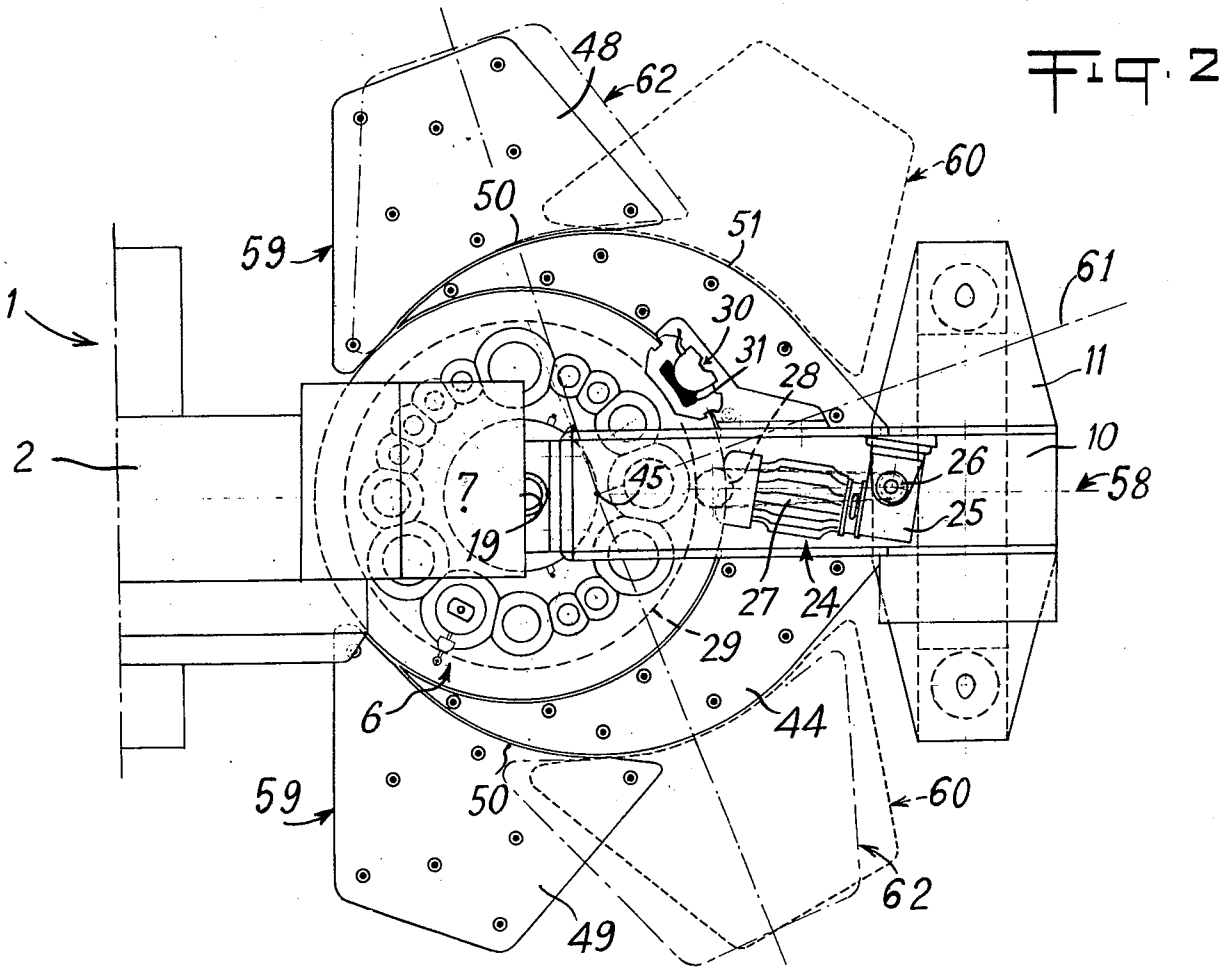
Figure 3:
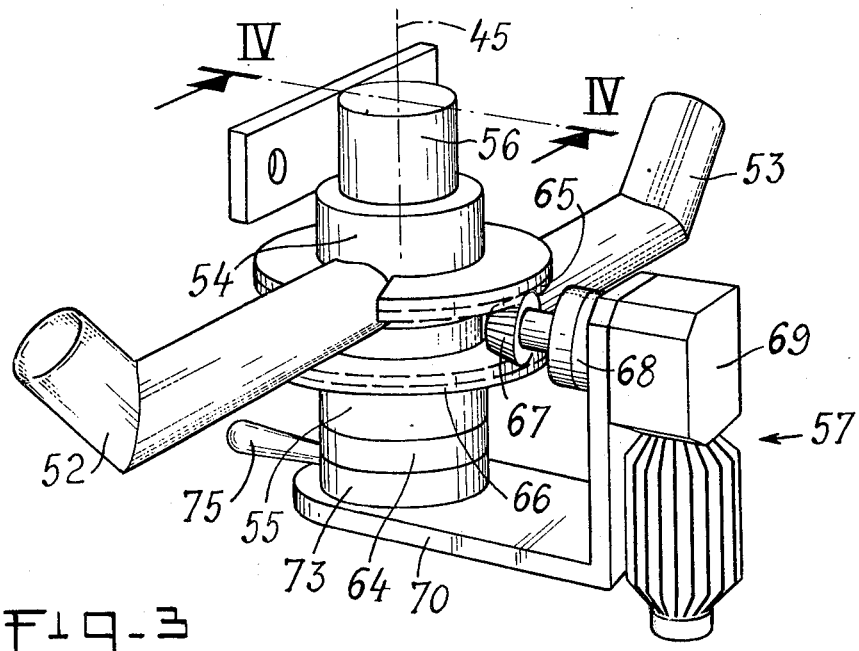

In these drawings:

FIG. 1 is a partial elevational view, showing the punching press having a turret according to the invention, certain parts of which have been illustrated very diagrammatically and others have been eliminated or cut-away to facilitate and understanding of the arrangement, FIG. 2 is a plan view relative to FIG. 1 and the illustration of which is also reduced for the same purpose, FIG. 3 is a partial perspective view of the mechanism for driving the lateral movable members of the table.

Figure 4:
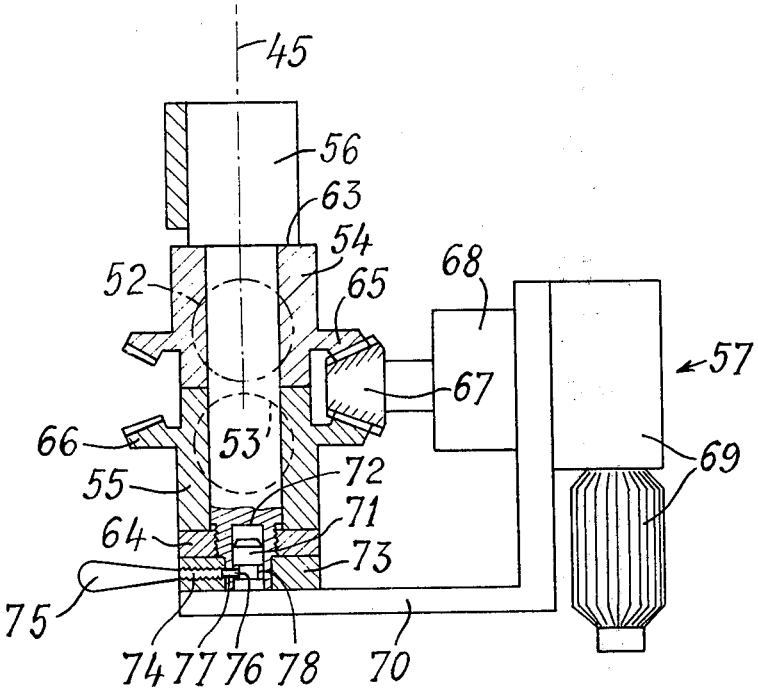

FIG. 4 is a partial vertical sectional view taken on line IV—IV of FIG. 3.

The reference numeral 1 designates a punching press, whereof only the active end has been illustrated. However, the essential parts with which the means characteristic of the invention co-operate, are shown. This press 1, comprises a swanneck frame 2 having an upper arm 3 and a lower arm 4 separated by a slot 5. The height of the latter is relatively great at the front to facilitate the intervention of a turret 6. But this height corresponds to what it should be on a simple punching press and decreases towards the back to facilitate solely the passage and displacement of the metal sheet to be machined.

At its free end, the upper arm 3 is provided with a punching head 7 in which a striker slide 8 is guided to move in alternating vertical translation and is connected to a drive device transmitting the punching power. At its free end, the lower arm 4 is integral with an anvil 9 able to receive the punching force.

According to the invention, the turret 6 is mounted not in the main swanneck 2, but in an auxiliary swanneck frame 10 extending as an elongation of the former 2 and towards the outside.

The auxiliary frame 10 is supported by a foot 11 resting on the ground, as well as by the main swanneck 2. In fact, the lower arm 13 of this swanneck 10 rests by means of a plate 14 on the anvil 9 and is fixed to the latter.

The arms 12 and 13 are sufficiently separated to define a space 15 in which the turret 6 may be housed and intervene freely. Opening into this space 15 is a slot 16 extending to a coplanar manner, that of the same height (not shown in the drawing) of the main frame 2, these slots being sufficiently deep to allow, as abovementioned, the passage and displacement of the metal sheet to be machined, both towards the front and towards the rear.

As is well known, the turret 6 comprises an upper plate 17 and a lower plate 18 integral with coaxial shafts 19 and 20 mounted to rotate respectively in the upper arm 12 and lower arm 13. The upper plate 17 supports detachable punches 21, appropriately distributed with equal radial spacing from the shaft 19, which are vertically movable and able to be taken in charge selectively, during the rotation of this plate, by the slide 8.

Similarly, opposite the punches 21, the lower plate 18 supports corresponding dies 22 which, since this plate rests plumb with the slide 8 on the plate 14, itself resting on the anvil 9, are perfectly capable of supporting the punching force when they are selected.

Naturally, a free space 23 is provided between the punches 21 of the upper plate 17 and the dies 22 of the lower plate 18, this free space being situated in the same plane as the slot 16 of the auxiliary frame and the corresponding slot of the main frame.

The two plates 17 and 18 must be able to be rotated strictly in synchronism, in order that the punches and dies are always opposite each other and, in addition, they must be able to be indexed accurately in order that the punch and die selected and arranged plumb with the punching head 7 extend strictly coaxially under the slide 8.

To this end, the plates 17 and 18 are placed under the dependence of a common driving device 24 (FIG. 2) which may be constituted by a speed-reduction group 25 whose output shaft is integral with two pinions 26 connected by chains 27 to two other pinions 28 permanently meshing with toothed rings 29 integral with the plates 17 and 18 respectively. Thus, the latter may be driven in synchronism, i.e. be moved at the same time through the same angle.

This driving device 24 co-operates with a braking mechanism 30 comprising two pairs of shoes 31 able to grip two peripheral discs 32 and 33 of the plates 17 and 18, the shoes being moved by a common oleo-pneumatic control 34.

The driving device 24 and braking device 30 also co-operate with an indexing device 35 comprising two fingers 36 and 37 movable in radial translation and able to co-operate selectively with housings 38 and 39 provided in the periphery of the plates 17 and 18, these housings being distributed angularly in the same manner as the punches and dies. The fingers 36 and 37 are simultaneously actuated by a common pneumatic control 40 acting on a rocking lever 41 connected to the fingers 36 and 37 by transmission rods 42 and 43.

Naturally, these three devices 24, 30 and 35 are supported by the auxiliary swanneck frame 10.

The result of the aforesaid is that the turret 6 as well as all the means controlling the latter are no longer integrated in the main swanneck frame 2, but in an auxiliary swanneck frame 10.

Therefore, the main frame produces performances at least as good as those obtained with simple punching presses.

Naturally, it may be advantageous for improving the positioning accuracy of the turret 6 relative to the striker slide 8, to fix the upper arm 12 of the second swanneck 10 to a fitting **12*a* of the punching head 7 supported by the first swanneck 1.**

Since the auxiliary frame exists, it is no longer necessary to anchor to the floor, the table intended to support the metal sheet to be machined, during its displacement.

Under these conditions, the table of the invention comprises a fixed member 44 (FIG. 2) having a substantially circular shape centered on a geometric axis 45 extending in the plane of the geometric axes 46 of the turret and 47 of the punching head, this axis 45 being located with respect to the axis 46, opposite the axis 47. Consequently, the member 44 fixed to the frame 10 partially surrounds the turret 6.

The table also comprises two lateral movable members 48 and 49 enlarging the support surface for the metal sheet to be machined. The inner edge 50 of these members is curved concentrically with respect to the axis 45 and consequently follows the shape of the outer edge 51 of the fixed member 44.

The lateral members 48 and 49 are integral with descending arms 52 and 53 (FIGS. 1 and 3) which, at their lower ends, are provided with bushes 54 and 55 mounted to pivot about a common pillar 56 fixed under the auxiliary frame 10 and extending along the aforesaid axis 45.

Furthermore, said moving members are connected to a synchronous drive mechanism 57, moving them symmetrically with respect to any plane.

If this plane of symmetry is the plane 58 passing through the axis of the shafts 19, 20 of the turret and through the axis 45 of the pillar 56 (FIG. 2), the moving members 48 and 49 are able to occupy a front position 59 (shown in full line), a rear position 60 (shown in broken line), and any intermediate position. In all these positions, said moving members 48 and 49 are equidistant from the reference rule against which the metal sheet to be machined bears.

If the plane of symmetry is any plane, such as 61 (FIG. 2) forming an appropriate angle with the aforesaid plane 58, the moving members may occupy a position such as 62 (illustrated in dot-dash line) and are thus particularly capable of supporting a so-called unbalanced metal sheet, for example in the shape of a trapezium.

The mechanism 57 makes it possible to modify the orientation of this plane of symmetry 61 with respect to the mediam plane 58, then to pivot the moving members 48 and 49 by the same angle relative to this plane 61.

To this end, the mechanism 57 illustrated in FIGS. 3 and 4, thus comprises the pillar 56, on which are threaded and superimposed the bushes 54 and 55 of the arms 52 and 53. These bushes are moreover interposed, in order to be able to pivot freely, between a shoulder 63 of the pillar and a nut 64 screwed to the latter. Furthermore, they are integral with toothed conical sectors 65 and 66 respectively, concentric with respect to the axis 45 of the pillar and separated from each other.

The sectors 65, 66 mesh with a conical pinion 67 interposed therebetween such that the latter, whilst rotating about its fixed axis, pivots the arms 52 and 53 in opposite directions and through the same angle.

The pinion 67 is connected by means of a torque limiting member 68, to a speed-reduction group 69 supported by the ascending arm of a bracket 70, whose substantially horizontal arm is pivotally mounted about the axis 45 and able to be locked, in any angular position, relative to the pillar 56.

In the example shown, the bracket 70 is integral with a cylindrical pivot 71 intended to be engaged in a blind bore 72 of the lower end of the pillar 56, which is provided with a ring 73. Moreover, a screw 74 mounted in the ring is extended, at one end, by an actuating lever 75 and, at its other end, by a finger 76 passing through a hole 77 in the pillar and penetrating a groove 78 of the pivot. Thus, when the screw 74 is slightly loosened, its finger 76 prevents the axial translatory movement of the pivot 71 and prevents the bracket 70 from dropping. However, the latter is free to pivot, the pinion 67 thus rolling on the sectors 65 and 66, leaving them immobile. On the other hand, when the screw 74 is locked by abutment of the finger 76 against the base of the groove 78 of the pivot 71, the rotation of the pinion 67 caused by the speed-reduction group 69 has the effect of pivoting the sectors 65 and 66, thus the arms 52, 53 and the members 48, 49 through the same angle, in opposite directions.

In other words, in order to regulate the position of said members 48 and 49, it is firstly sufficient to chose the plane of symmetry 61 (by unlocking the screw 74, rotating the bracket 70 and re-locking this screw), then to cause the arms 52 and 53 to pivot symmetrically (by controlling the speed-reduction group 69).

The invention is not limited to the embodiment illustrated and described in the aforesaid, since various modifications may be applied thereto, without diverging from its framework.

In particular, instead of the arms 12 and 13 of the auxiliary frame being aligned with the arms 3 and 4 of the main frame, it may be advantageous if their planes are parallel and offset laterally or even if they form an angle therebetween.

As will be appreciated by the artisan from the foregoing the invention provides a punch press unit 1 and a tool exchange unit with a swan neck or C-shaped frame 10, which tool exchange unit is fixedly connected to the punch press unit 1 for operation therewith. The punch press unit also has a swan neck or C-shaped frame 2, which frame 2 supports an anvil 9 and a ram associated with striker slide 8. The ram and anvil are in opposite spaced apart relation, and the ram is moveable relative to the anvil along a given path which is the axis 47. The C-shaped frames of the punch press and tool exchange units are disposed in laterally spaced relation to each other with the openings of both of these frames being in generally facing relation to each other even though the arms of these frames might be in parallel and offset planes, or in planes forming an angle.

The tool exchange unit is provided with turret means 6 supported by the frame 10 of such unit having rotation relative thereto about an axis which is fixed, to selectively position punch and die sets carried by the turret means 6 into registry with the ram and anvil of the punch press unit.

The tool exchange unit is provided with base means 11 disposed to engage a base surface, such as that upon which the punch press unit is mounted, to support thereupon at least a portion of the weight of the tool exchange unit, as is clearly indicated in FIG. 1, whereby the punch press unit need not bear the entire load of the tool exchange unit.

The improvements, which are the object of the invention, may be applied to punching and/or nibbling presses equipped with a punch support turret and dies and preferably to automatic and programmed presses, both as regards the selection of the punches and dies, as well as the displacement of the metal sheet to be machined.

I claim:

1. A punch press apparatus comprising a punch press unit and a tool exchange unit fixedly connected to said punch press unit for operation therewith; said punch press unit having a C-shaped frame, an anvil supported by said frame, and a ram supported by said frame in opposite spaced-apart relation to the anvil and moveable relative thereto along a given path; said tool exchange unit having a C-shaped frame disposed in laterally spaced relation to the C-shaped frame of the punch press unit, the openings of said C-shaped frames being in generally facing relation to each other, said tool exchange unit having turret means supported by the frame of such unit for rotation relative thereto about a fixed axis to selectively position punch and die sets carried by the turret means into registry with said ram and anvil.

2. A punch press apparatus according to claim 1 wherein the C-shaped frames of said punch press unit and tool exchange unit have respective upper arms and lower arms, and an arm of the punch press unit frame is connected to an arm of the tool exchange unit frame to precisely establish the position of the turret means rotation axis with respect to the ram movement path.

3. A punch press apparatus according to claim 1 including table means supported by said tool exchange unit, said table means including at least one adjustable table member for supporting material to be worked.

4. A punch press apparatus according to claim 1 wherein said tool exchange unit has a base means disposed to engage a base surface to support thereupon at least a portion of the weight of the tool exchange unit.

5. A punch press apparatus according to claim 1 including powered indexing means connected to said turret means for positioning same angularly with respect to said ram and anvil.

* * * * *